US005273677A

United States Patent [19]

Arif

[11] Patent Number: 5,273,677

[45] Date of Patent: Dec. 28, 1993

[54] RINSE AIDS COMPRISING ETHOXYLATED-PROPOXYLATED SURFACTANT MIXTURES

[75] Inventor: Shoaib Arif, Cheshire, Conn.

[73] Assignee: Olin Corporation, Cheshire, Conn.

[21] Appl. No.: 856,139

[22] Filed: Mar. 20, 1992

[51] Int. Cl.[5] ..... C11D 1/66; C11D 1/68; C11D 1/12

[52] U.S. Cl. ..... 252/174.21; 252/174.22; 252/559; 252/DIG. 7; 252/DIG. 5

[58] Field of Search ..... 252/174.21, 174.22, 252/559, DIG. 1, DIG. 5

[56] References Cited

U.S. PATENT DOCUMENTS

| | | | |
|---|---|---|---|
| 3,956,401 | 3/1976 | Scardera et al. | 252/89 R |
| 3,969,134 | 7/1976 | Batka | 134/26 |
| 4,070,298 | 1/1978 | Scardera et al. | 252/89 R |
| 4,207,421 | 6/1980 | Scardera et al. | 568/625 |
| 4,272,394 | 6/1981 | Kaneko | 252/99 |
| 4,280,919 | 7/1981 | Stoeckigt et al. | 252/135 |
| 4,317,940 | 3/1982 | Scardera et al. | 260/615 B |
| 4,443,270 | 4/1984 | Biard et al. | 134/25.2 |
| 4,624,803 | 11/1986 | Balzer | 252/527 |
| 4,647,314 | 3/1987 | Mullins et al. | 134/30 |
| 4,711,738 | 12/1987 | Copeland | 252/95 |
| 4,950,424 | 8/1990 | van der Hoeven | 252/540 |
| 5,114,607 | 5/1992 | Deck et al. | 252/156 |

FOREIGN PATENT DOCUMENTS 60-235900 11/1985 Japan .

*Primary Examiner*—Paul Lieberman
*Assistant Examiner*—Kery A. Fries
*Attorney, Agent, or Firm*—Dale Lynn Carlson

[57] ABSTRACT

A rinse aid composition and a rinse aid concentrate which comprises an aqueous solution of a low foam surfactant, a solubilizing system for the low foam surfactant, and an anionic dispersing agent. This rinse aid controls foam, improves water solubility, reduces surface tension which improves sheeting action that reduces spotting, streaking and filming of the articles washed, provides an appropriate cloud point, and reduces drying time.

13 Claims, No Drawings

RINSE AIDS COMPRISING ETHOXYLATED-PROPOXYLATED SURFACTANT MIXTURES

FIELD OF THE INVENTION

This invention relates to a rinse aid composition used in a rinse concentrate. The rinse concentrate is an aqueous solution of a low foam nonionic surfactant, a solubilizing system for the low foam surfactant, and an anionic dispersing agent.

BACKGROUND OF THE INVENTION

In the automatic dishwashing of dishes, glassware and flatware, the articles to be cleaned generally are first subjected to a main washing step, which is subsequently followed by one or more rising steps to remove adhering main-wash detergent ingredients and/or remaining soil. This rinse step drains any residual water from the surface of the articles and prevents the spotting, streaking, and filming of the washed and dried articles. It is customary to add in the rinsing step a rinse aid which causes the articles to dry more evenly and improves the visual appearance of the articles when dry.

When rinse water falls on a washed article, some residual water always is left on the article. The function of the rinse aid is to cause a sheeting action which drains the water remaining from the article. The sheeting action is induced because of hydrophobicity and the surface tension reduction properties of the rinse aid surfactant. In both household and institutional dishwashing machines, a good sheeting action provides the benefits of no spotting or streaking or filming on the washed article, reduces drying time, and removes any residual soil particulate.

Protein soil on the articles to be washed causes foaming in the dishwashing machine. Foam, or more specifically entrapped air, in the wash spray will reduce the mechanical efficiency of the spray function and interfere with maximum soil removal which in turn reduces the washing and cleaning ability of the dishwashing machine. Foam also adheres to the washed article and causes spotting and streaking if not removed. Soil can be trapped inside the foam and not get washed away. Thus, it is desirable for a rinse aid to have a food soil defoaming activity.

Because of the vigorous liquor movement and the spraying mode of washing and rinsing both in household and institutional dishwashing machines, a rinse aid formulation must be low-foaming. Rinse aids based on nonionic surfactants, for example, ethylene oxide and propylene oxide adducts of fatty alcohols, ethylene and propylene oxide block copolymers and other low foam nonionic surfactants are now widely used.

However, it has been found that the rinse aids containing nonionic surfactants may produce too much foam in the concentration ranges required for an adequate wetting effect. This leads to problems in the dishwashing machines through excessive foaming.

Most surfactants used in commercial rinse aids are hydrophobic in nature and thus, they require a hydrotrope to keep these surfactants in solution during storage. A hydrotrope is used to perform the necessary solubilization of any hydrophobic nonionic surfactants in water. Some commonly used hydrotropes are sodium naphthalene sulfonate, sodium xylene sulfonate or sodium cumene sulfonate.

A typical commercial batch of rinse aid is produced by mixing the nonionic rinse aid surfactants with the hydrotrope. A dispersing agent is then mixed in the batch. Finally, the required amount of water is added and mixed until a homogenous solution is obtained. Dyes, perfumes, sequestering agents (which inhibit precipitation of water hardness salts), and preservatives are optionally added to the batch. These rinse aids are injected into the final rinse water at a concentration of about 50 to 500 parts per million.

Generally a rinse aid or rinse aid composition is defined as including the surfactant and the solubilizing system for the surfactant. A rinse aid concentrate includes the rinse aid composition, a dispersing agent for the surfactants and water plus other optional ingredients as desired to accomplish specific purposes. A rinse concentrate is usually 40%-100% active ingredients. Commercial distributors and vendors purchase the concentrate, add water to dilute it to 8%-40% active ingredients and sell it. Usually a rinse solution is used to refer to the fully diluted aqueous solution which is sprayed on the articles to be washed within the machine spray washer. These terms will be used throughout the application.

Nonionic surfactants known to be low foaming include for example block copolymers of polyoxypropylene-polyoxyethylene or ethylene oxide and propylene oxide adducts of fatty alcohols such as poly(oxyalkylated) alcohols which are represented by the formula:

$$RO-(PO)_x-(EO)_y-(PO)_z-H \qquad (I)$$

wherein

R is a linear, alkyl hydrocarbon having an average of from about 7 to about 10 carbon atoms;

PO stands for propylene oxide groups $$(CH_2-\underset{\underset{CH_3}{|}}{CH}-O)$$

and

EO stands for ethylene oxide groups ($CH_2-CH_2-O$);

x is an integer having a value from 1 to 6;

y is an integer having a value from 4 to 15; and z is an integer having a value from 4 to 25.

U.S. Pat. No. 4,443,270 discloses a rinse aid composition for use in automatic dishwashing machines comprising a low foaming ethoxylated nonionic surfactant, an organic chelating agent, a hydrotrope-water solubilizing system and magnesium, zinc, tin, bismuth or titanium ions in the form of a water soluble salt.

While low foam surfactants have improved the sheeting action of rinse water on surfaces, they have not completely eliminated spotting and streaking problems. It is desirable to make the surface of the article to be washed as hydrophobic as possible because a more hydrophobic surface will enhance the removal of the residual water and this reduces spotting, streaking and filming on the washed articles when they are dried.

SUMMARY OF THE INVENTION

It is an object of the present invention to provide a rinse aid composition for use in automatic dishwashing machines.

Another object of the invention is to provide a rinse aid concentrate for use in the rinse cycle in automatic dishwashing machines.

These and other objects of the invention are accomplished with an improved rinse aid composition used in a rinse aid concentrate comprising an aqueous solution of a low foam nonionic surfactant, a solubilizing system, and an anionic dispersing agent which concentrate controls foam, improves sheeting action thereby reducing spotting and streaking, and reduces drying time.

DETAILED DESCRIPTION OF THE INVENTION

Rinse aid compositions in accordance with the invention comprise a low foam nonionic surfactant, and a solubilizing system for the low foam surfactant, while the rinse aid concentrate contains in addition to the foregoing composition an anionic dispersing agent and water. This rinse aid of the invention effectively defoams protein soil; induces a sheeting action which removes any water remaining on the article being washed thus eliminating spotting, streaking and filming; reduces drying time; does not require a hydrotrope to solubilize the low foam nonionic surfactant; has an appropriate cloud point; has good dispersing properties; and is ready to use as a concentrate. The reduction in drying time is of the utmost relevance to automatic dishwashing operations, particularly in household dishwashing applications since it opens the possibility of reducing the drying time after the rinse cycle and consequently achieving energy savings.

Suitable low foam nonionic surfactants for the present invention include for example ethylene oxide and propylene oxide adducts of fatty alcohols such as poly(oxyalkylated) alcohols, or the block copolymers of polyoxypropylene-polyoxyethylene.

The poly(oxyalkylated) alcohols are preferred and may be made by the methods disclosed in U.S. Pat. No. 3,956,401, which issued to M. Scardera and R. Scott on May 11, 1976, and U.S. Pat. No. 4,317,940, which issued to M. Scardera and F. Grosser on Mar. 2, 1982. The disclosure of these patents is incorporated herein by reference in its entirety.

Generally, poly(oxyalkylated) alcohols of this type may be made by first condensing a primary alcohol or alcohols of desired average chain length with PO, followed by reacting that condensation product with EO, followed by capping that intermediate product with more PO. The moles of PO, EO, and PO per mole of alcohol employed in these reactions will fall within the ranges of "x", "y", and "z", respectively, given below. The reaction temperature and catalysts used would be the same as employed to obtain low foaming surfactants.

The nonionic surfactant consists of three components—an alkyl alcohol, ethylene oxide and propylene oxide groups. The alcohol serves as a hydrophobic, oil-soluble portion of the surfactant. The ethylene oxide is a hydrophilic water-soluble element of the surfactant. To improve the hydrophobicity of the surfactant, the propylene oxide group is present. The PO group provides both hydrophobicity and a low foaming tendency. Solubility of the surfactant is determined by the balance between hydrophilic and hydrophobic groups. The higher the number of PO groups and the longer the carbon chain of the alcohol, the greater the hydrophobicity and the greater the low foaming tendency. Accordingly, these nonionic surfactants are hydrophobic and have low foaming properties. As a general rule, the useful surfactants will have a molecular weight range of about 700 to about 14,000. These types of surfactants are sold commercially under the brand name POLY-TERGENT® surfactants from the Olin Corporation and are also available under other trademarks from other chemical suppliers.

Illustrative poly(oxyalkylated) alcohols are those represented by the formula:

$$RO-(PO)_x-(EO)_y-(PO)_z-H \qquad \text{(IA)}$$

wherein

R is a linear, alkyl hydrocarbon having an average of from about 7 to about 10 carbon atoms;

PO stands for propylene oxide groups $$(CH_2-\underset{\underset{CH_3}{|}}{CH}-O)$$

and

EO stands for ethylene oxide groups ($CH_2-CH_2-O$);

x is an integer having a value from 1 to 6;

y is an integer having a value from 4 to 15; and z is an integer having a value from 16 to 25.

The preferred low foam nonionic surfactant of the invention is that surfactant of formula (IA) wherein x is an integer having a value of from 2 to 4, and most preferably 3; y is an integer having a value of from 5 to 12 and most preferably 12; and z is an integer having a value of from 16 to 20 and most preferably of from 16 to 18. The most preferred surfactant has the best food soil defoaming activity. The amount of low foam surfactant in the rinse aid composition which is effective in achieving low foaming and improved sheeting is for example from about 6.25% to about 25% by weight based upon the combined weight of the low foam surfactant and the solubilizing system surfactants and preferably from about 15% to about 25%. In the rinse concentrate, the effective amount of low foam surfactant would be from about 5% to about 20% by weight based upon the weight of the overall rinse aid concentrate formula and preferably from about 10% to about 20%.

The rinse aid of the invention uses a solubilizing system to force and keep the hydrophobic low foam nonionic surfactant in solution instead of using a conventional hydrotrope in the rinse aid formulation. One of the benefits this type of solubilizing system is the reduction in the amount of different types of effluent material going into the waste drain from the dishwashing machine. The appearance of the rinse aid is very important—it must be clear and have good cosmetic appearance i.e. not be cloudy. Thus, the low foam hydrophobic surfactant must be kept in solution and not come out of solution even during long term storage of the rinse aid. It must have storage stability. The solubilizing system used in the present invention is a mixture of nonionic surfactants which act like a hydrotrope. They solubilize and keep solubilized the hydrophobic low foam nonionic surfactant of the rinse aid until the low foam nonionic surfactant must come out of solution in the dishwashing machine in order for the surfactant to perform as a rinse aid. The rinse aid should have a cloud point above the storage temperature, but below the application temperature.

Cloud point is a very important property of the surfactants in rinse aids and is the minimum temperature at which a nonionic surfactant comes out of its solution and forms a suspension. A cloud point of 100° to 120° F. is typical of commercially available rinse aids. This insures that even in summer time when the temperature goes above 90° F., the nonionic surfactant will not separate in the storage container. Normally the rinse water temperature of household and institutional machines is from 120° to 180° F. The cloud point of the low foam nonionic surfactant of the invention is 110° F. which is appropriate for both storage and application conditions.

The solubilizing system of the invention is a mixture of two nonionic surfactants of the general type represented by the formula:

$$R_1O-(PO)_{x'}-(EO)_{y'}-(PO)_{z'}-H \quad \text{(II)}$$

wherein in each component of the system:

$R_1$ is a linear, alkyl hydrocarbon having an average of from about 7 to about 10 carbon atoms;

PO stands for propylene oxide groups $$(CH_2-\underset{\underset{CH_3}{|}}{CH}-O)$$

and

EO stands for ethylene oxide groups ($CH_2-CH_2-O$);

x' is an integer having a value from 1 to 6;

y' is an integer having a value from 4 to 15; and z' is an integer having a value of from 4 to 15 and each of said surfactants must have a z' different from each other.

In accordance with the preferred embodiments of the invention, x' ranges from 2 to 4, most preferably 3; and y' ranges from 5 to 12, most preferably 12. Moverover, the value of z' in the first of the two surfactants ranges from 4 to 10, more preferably from 5 to 9 and most preferably 8; and the value of z' in the second of the two surfactants ranges from 11 to 15, more preferably from 12 to 15 and most preferably 15.

The nonionic surfactants of the solubilizing system have a dual function and are selected so that they compliment each other to achieve a predetermined desired result by providing the right proportion of hydrophilicity and hydrophobicity. Or stated in another way the proportion of PO and EO groups in each nonionic surfactant solubilizer and the entire solubilizing system determine the properties of the system.

The solubilizing system is used in an effective amount to solubilize the low foam nonionic surfactant and keep it in solution during storage. The exact quantity thereof is determined by the cloud point of the final formulation and by the desired stability in storage and may be varied as required within the limits mentioned without in any way affecting the excellent final rinse effects obtained by using the low foam surfactants of general formula (IA). Illustratively, an effective amount of the solubilizing system may range from about 75% to about 93.75% by weight, based upon the weight of all surfactants in the total rinse aid composition and most preferably from about 75% to about 85%. The ratio of the first solubilizing system surfactant to the second surfactant can be varied widely so long as it is effective in solubilizing the low foam surfactant, preferably in the range about 4:1 to about 2.5:1 with the most preferable about 3:1. In the rinse aid concentrate, an effective amount of the solubilizing system may range from about 80% to about 95% based upon the weight of the total rinse concentrate and preferably from about 80% to about 90%.

Since the rinse aid composition contains nonionic hydrophobic surfactants, the surfactants in the composition when added to rinse water, especially at high temperatures, tend to form globules rather than dispersing into a fine a milky suspension. In order to achieve a good dispersion, the present invention uses an anionic dispersing agent which gives good dispersing properties to the rinse aid composition in the concentrate. Any suitable anionic dispersing agents such as phosphate esters, sulfosuccinates, sodium naphthalene, alkyl diphenyl oxide sulfonic acid and salts thereof may be used. The alkali metal and alkaline earth metal salts of alkyl diphenyl oxide sulfonic acid represented by the following formula are preferred:

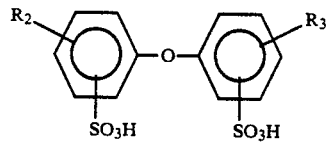

(III)

wherein $R_2$ and $R_3$ are independently H or a linear or branched alkyl hydrocarbon having from about 6 to about 16 carbon atoms, preferably selected from the group consisting of linear $C_{10}$, linear or branched $C_{12}$ and linear $C_{16}$, most preferably linear $C_{10}$. In accordance with the preferred embodiment at least one of two radicals $R_2$ and $R_3$ is an alkyl hydrocarbon. Suitable salts are the salts of the alkali metals potassium, sodium, and lithium and of the alkaline earth metals calcium, magnesium, and barium. A preferred salt is the sodium salt.

The dispersing agents used in the invention also have the added properties of providing a detergent action to the rinse aid. The anionic dispersing agents are available commercially as POLY-TERGENT ® surfactant from the Olin Corporation and under the DOWFAX ® brand name from Dow Chemical Company.

The anionic dispersing agent is used in an effective dispersing amount such as from about 0.25% to about 10% by weight of the total rinse aid concentrate, more preferably from about 0.5% to about 5.0%, and most preferably from about 0.75% to about 1.0%.

A rinse aid concentrate can be formulated by preparing an aqueous solution of the rinse aid composition with from 20% to 50% by weight of water (preferably from about 15% to about 35%, most preferred 20%) and an effective amount of an anionic dispersing agent as set forth above.

The rinse aid composition normally contains low foam surfactant and solubilizing system for the surfactant. The order of addition and mixing of the various ingredients of the formulation in not critical. The rinse aid composition can be sold as such, but it can also be sold as a rinse concentrate with the addition of water and dispersing agent. This rinse concentrate can be used directly in final dilution in the rinse cycle.

Optionally, this rinse aid concentrate may be diluted to commercially acceptable ranges of from about 10% to about 40% active ingredients in water. This stock solution in turn can be used in the rinsing application in dish washing machines, in ranges of from about 50 to 500 parts per million of the final rinse water. The formulation may include one or more optional ingredients such as sequestering agents which serve to inhibit precipitation of water hardness salts, a fragrance, a biocide, a dye, and the like.

The rinse aid of this invention is adaptable for the normal rinse water temperatures used in dish washing machines.

The following examples are presented to further illustrate the invention without any intention of being limited thereby. All parts and percentages are by weight unless otherwise specified.

EXAMPLE 1

A 500 ml 3-necked round bottom flask containing a mechanical stirrer was fitted with a thermometer. 200 g of a low foam nonionic surfactant #1 was mixed with a solubilizing system mixture of 450 g of first solubilizing system surfactant #2 and 150 g of second solubilizing system surfactant #3; 10 g of dispersing agent surfactant #4 and 190 g of water. The mixture was stirred at reaction temperature of 25° C. for 60 minutes. The product weighed 1000 g.

Low Foam Surfactant #1 is:

$$R'O-(PO)_3-(EO)_{12}-(PO)_{16\text{-}18}-H \quad \text{(IV)}$$

First Solubilizing System Surfactant #2 is:

$$R'O-(PO)_3-(EO)_{12}-(PO)_8-H \quad \text{(V)}$$

Second Solubilizing System Surfactant #3 is:

$$R'O-(PO)_3-(EO)_{12}-(PO)_{15}-H \quad \text{(VI)}$$

wherein the following are defined as set forth below for the above formulas:

R' is $CH_3(CH_2)_{7\text{-}9}$

PO is $(CH_2-\underset{\underset{CH_3}{|}}{CH}-O)$

EO is $(CH_2-CH_2-O)$

Dispersing Agent Surfactant #4 is

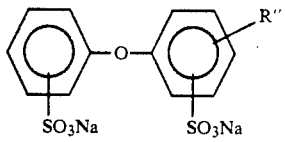

(VII)

wherein R'' is $(CH_2)_{10}CH_3$

The procedure of Example 1 was repeated, but the proportions of the ingredients were changed as indicated below:

| Example No. | 2 | 3 | 4 | 5 | 6 |
|---|---|---|---|---|---|
| Surfactant #1 | 200 | 350 | 350 | 350 | 400 |
| Surfactant #2 | 400 | 250 | 450 | 450 | — |
| Surfactant #3 | 200 | 200 | — | — | 400 |
| Surfactant #4 | 10 | 5 | — | 15 | 10 |
| $H_2O$ | 190 | 195 | 100 | 185 | 190 |
| Propylene Glycol | — | — | 100 | — | — |
| Comments | Hazy, Not Clear 1%,RT | Hazy, Not Clear 1%,RT | Hazy, Not Clear 1%,RT | Double Cloud Point, Behavior Unacceptable | Hazy, Not Clear 1%,RT |

RT = Room Temperature

The above data demonstrates when the solubilizing system is outside of the required ratio of the first and second surfactants of the solubilizing system the mixture is hazy in 1% aqueous solution at room temperature and not acceptable (note Example 2). When the surfactant #1 (the low foam surfactant) is outside the required range, the mixture is hazy (note Example 3). Examples 4, 5 and 6 show that both surfactants of the solubilizing system must be present in the invention in order to solubilize the low foam surfactant that is produce a clear solution not a hazy solution. Example 3 shows that even the addition of propylene glycol does not produce a clear solution.

To illustrate the surfactant properties of the low foam rinse aid of Example No. 1, the following tests were conducted, with results listed in Table A.

"Cloud Point" is an indication of water solubility. A 1% aqueous solution of the surfactant is heated until a point is reached where the surfactant begins to separate out, causing the solution to become turbid or cloudy. This is the "Cloud Point".

"Surface Tension" is the force related to the intermolecular attraction at a liquid-air interface. This property indicates the tendency of a liquid to spread or wet solid surfaces. (Per ASTM D 1331-56).

"Interfacial Tension" is the force related to the intermolecular attraction of a liquid-liquid or liquid-solid interface. This property is indictive of effective emulsification; bubble, film and foam formation and behavior; cleaning of fabrics; ore flotation; adhesives; etc. (Per ASTM D 1331-56).

"Draves Wetting Time" denotes the time required to wet a 5 g cotton skein in an aqueous solution of surfactant. This property is important to textile processing utility. (Per AATCC Method 17-1952).

"Ross-Miles Foam Height" is a measure of the foam height generated initially and remaining after five minutes in a surfactant solution. This test indicates both foaming tendency (low-moderate-high) and foam stability. (Per ASTM Method D 1173-53).

As Table A illustrates, the rinse aid composition of the present invention features good wetting and surface tension properties, storage stability, accelerated aging and freeze thaw stability tests demonstrate that the rinse aid will be stable at different storage conditions. The Ross-Miles, cylinder shake, and blender foam test results confirm that this rinse aid is low foaming.

TABLE A

| SURFACE PROPERTIES | Example 1 |
|---|---|
| Color | Colorless |
| Odor | Mild |
| Appearance | Clear Liquid |
| pH | |
| 1% Sol. | 5.4 |
| 10% Sol. | 5.3 |
| Viscosity cps @ 25° C. | 300 |
| Foam | |
| Ross Miles, mm @ 25° C. initial/30 sec./5 min. | |
| 0.50% active | 55/1/0 |
| 0.25% active | 45/5/0 |
| 0.10% active | 45/5/0 |

TABLE A-continued

| SURFACE PROPERTIES | Example 1 |
|---|---|
| @ 60° C. | |
| 0.50% active | 10/5/0 |
| 0.25% active | 10/3/0 |
| 0.10% active | 00/0/0 |
| Cylinder shake | 35/×/25 ml |
| Waring Blender | 9.1 cm. |
| Draves Wetting sec. | |
| @ 25° C. | |
| 0.50% active | 0 |
| 0.25% active | 11 |
| 0.10% active | 28 |
| @ 60° C. | |
| 0.50% active | 2 |
| 0.25% active | 2 |
| 0.10% active | 19 |
| Surface Tension dynes/cm. | |
| Static | |
| 0.50% active | 34.5 |
| 0.10% active | 34.0 |
| Dynamic 0.05% | 44.3 |
| Interfacial Tension dynes/cm. | 6.0 |
| Cloud Points | |
| 80.0% active | 67 |
| 40.0% active | 47 |
| 20.0% active | 45 |
| 10.0% active | 44 |
| 5.0% active | 44 |
| 1.0% active | 47 |
| Storage Stability | |
| Room Temp. | Formula stable for 4 weeks |
| 110° F. | Formula stable for 4 weeks |
| Freeze/Thaw Cycle | Stable for five cycles |
| % Rotor Speed | |
| No Soil | 100 |
| Milk Soil | 99 |
| Egg Soil | 108 |
| Deposition on Glasses | |
| Spotting | 1.7 |
| Streaking | 2.0 |
| Filming | 2.0 |

In rinse aid compositions, it is crucial to have a balance between solubilizing the hydrophobic surfactant and maintaining the optimum rinse aid properties. The composition of the invention addresses that balance by selecting the most appropriate ratios of the low foaming hydrophobic surfactant and the solubilizing system. This ratio had provided the composition with excellent protein soil defoaming and spotting and streaking control properties which caused excellent sheeting action.

While the invention has been described above with reference to specific embodiments thereof, it is apparent that many changes, modifications and variations can be made without departing from the inventive concept disclosed herein. Accordingly, it is intended to embrace all such changes, modifications and variations that fall within the spirit and broad scope of the appended claims. All patent applications, patents and other publications cited herein are incorporated by reference in their entirety.

What is claimed is:

1. A clear liquid low foaming rinse aid composition comprising:

(a) at least one low foam nonionic surfactant represented by the formula:

$$RO-(PO)_x-(EO)_y-(PO)_z-H \quad \text{(IA)}$$

wherein R is a linear, alkyl hydrocarbon having an average of from about 7 to about 10 carbon atoms;

PO stands for propylene oxide groups $$(CH_2-\underset{\underset{CH_3}{|}}{CH}-O)$$

and

EO stands for ethylene oxide groups ($CH_2-CH_2-O$);

x s an integer having a value from 1 to 6;

y is an integer having a value from 4 to 15; and z is an integer having a value from 16 to 25; and (b) an effective amount of a solubilizing system comprising at least two surfactants, being a first solubilizing surfactant and a second solubilizing surfactant, each said surfactant represented by the formula:

$$R_1O-(PO)_{x'}-(EO)_{y'}-(PO)_{z'}-H \quad \text{(II)}$$

wherein in each component of the system:

$R_1$ is a linear, alkyl hydrocarbon having an average of from about 7 to about 10 carbon atoms;

PO stands for propylene oxide groups $$(CH_2-\underset{\underset{CH_3}{|}}{CH}-O)$$

and

EO stands for ethylene oxide groups ($CH_2-CH_2-O$);

x' is an integer having a value from 1 to 6;

y' is an integer having a value from 4 to 15; and z' is an integer having a value of from 4 to 15 with the proviso that each of said surfactants must have a z' different from the other, wherein the first surfactant has a value of z' equal to 4 to 10 and the second surfactant has a z' value of 11 to 15, the amount of said low foam nonionic surfactant being between about 6.25% and about 25% based upon the weight of said low foam nonionic surfactant plus said solubilizing system in said concentrate, the amount of said solubilizing system being between about 75% and about 93.75% based upon the weight of said low foam nonionic surfactant plus said solubilizing system in said concentrate, and the weight ratio of said first solubilizing surfactant to said second solubilizing surfactant being between about 4:1 and about 2.5:1.

2. The low foaming rinse aid composition as set forth in claim 1 wherein x is an integer having a value of from 2 to 4, y is an integer having a value of from 5 to 12, and z is an integer having a value of from 16 to 20.

3. The low foaming rinse aid composition as set forth in claim 2 wherein x is an integer having a value of 3, y is an integer having a value of 12, and z is an integer having a value of from 16 to 18.

4. The low foaming rinse aid composition as set forth in claim 1 wherein x' is an integer having a value of from 2 to 4 y' is an integer having a value of from 5 to 12, and the value of z' for one of said surfactants is from 4 to 10 and its value for the other surfactant is from 11 to 15.

5. The low foaming rinse aid composition as set forth in claim 4 wherein x' is an integer having a value of 3, y' is an integer having a value of 12, and the value of z' for one of said surfactants is 8 and its value for the other surfactant is 15.

6. The low foaming rinse aid composition as set forth in claim 2 wherein x' is an integer having a value of from 2 to 4, y' is an integer having a value of from 5 to 12, and the value of z' for one of said surfactants is from 4 to 10 and its value for the other surfactant is from 11 to 15.

7. The low foaming rinse aid composition as set forth in claim 3 wherein x' is an integer having a value of 3, y' is an integer having a value of 12, and the value of z' for one of said surfactants is 8 and its value for the other surfactant is 15.

8. The low foaming rinse aid composition as set forth in claim 4 wherein the ratio of the surfactant having a z' value between 4 to 10 to the surfactant having a z' value between 11 to 15 is 4:1 to 2.5:1.

9. The low foaming rinse aid composition as set forth in claim 8 wherein the ratio of the surfactant having a z' value between 4 to 10 to the surfactant having a z' value between 11 to 15 is 3:1.

10. The low foaming rinse aid composition as set forth in claim 6 wherein the ratio of the surfactant having a z' value between 4 to 10 to the surfactant having a z' value between 11 to 15 is 4:1 to 2.5:1.

11. The low foaming rinse aid composition as set forth in claim 7 wherein the ratio of the surfactant having a z' value of 8 to the surfactant having a z' value of 15 is 3:1.

12. A process of rinsing washed articles in a dishwashing machine which comprises adding thereto during the rinse cycle a clear, liquid rinse aid composition containing:

(a) a low foam nonionic surfactant represented by the formula:

$$RO-(PO)_x-(EO)_y-(PO)_z-H \quad (I)$$

wherein R is a linear, alkyl hydrocarbon having an average of from about 7 to about 10 carbon atoms;

PO stands for propylene oxide groups $$(CH_2-\underset{\underset{CH_3}{|}}{CH}-O)$$

and

EO stands for ethylene oxide groups ($CH_2-CH_2-O$);

x is an integer having a value from 1 to 6;

y is an integer having a value from 4 to 15; and z is an integer having a value from 16 to 25; and (b) an effective amount of a solubilizing system comprising at least two surfactants, being a first solubilizing surfactant and a second solubilizing surfactant, each said surfactant represented by the formula:

$$R_1O-(PO)_{x'}-(EO)_{y'}-(PO)_{z'}-H \quad (II)$$

wherein in each component of the system:

$R_1$ is a linear, alkyl hydrocarbon having an average of from about 7 to about 10 carbon atoms;

PO stands for propylene oxide groups $$(CH_2-\underset{\underset{CH_3}{|}}{CH}-O)$$

and

EO stands for ethylene oxide groups ($CH_2-CH_2-O$);

x' is an integer having a value from 1 to 6;

y' is an integer having a value from 4 to 15; and z' is an integer having a value of from 4 to 15 with the proviso that each of said surfactants must have a z' different from the other, wherein the first surfactant has a value of z' equal to 4 to 10 and the second surfactant has a z' value of 11 to 15, the amount of said low foam nonionic surfactant being between about 6.25% and about 25% based upon the weight of said low foam nonionic surfactant plus said solubilizing system in said concentrate, the amount of said solubilizing system being between about 75% and about 93.75% based upon the weight of said low foam nonionic surfactant plus said solubilizing system in said concentrate, and the weight ratio of said first solubilizing surfactant to said second solubilizing surfactant being between about 4:1 and about 2.5:1.

13. A rinse aid concentrate comprising (a) the rinse aid composition of claim 1, (b) water, and (c) a diphenyl oxide sulphonic acid anionic dispersing agent present in amount of between about 0.25% and about 10% by weight based upon the weight of said concentrate, said water being present in said concentrate in an amount of between about 15% and about 35% by weight based upon the weight of the concentrate.

* * * * *